United States Patent [19]

Manders

[11] Patent Number: 4,643,233

[45] **Date of Patent: * Feb. 17, 1987**

[54] METHOD FOR CONVEYING A FLEXIBLE THREAD BY MEANS OF A PRESSURIZED GAS

[75] Inventor: Petrus G. J. Manders, Eindhoven, Netherlands

[73] Assignee: Rüti-Te Strake B.V., Netherlands

[ * ] Notice: The portion of the term of this patent subsequent to Nov. 5, 2002 has been disclaimed.

[21] Appl. No.: 741,882

[22] Filed: Jun. 3, 1985

Related U.S. Application Data

[63] Continuation of Ser. No. 394,936, filed as PCT NL81/00026, Nov. 13, 1981, published as WO82/01728, May 27, 1982, Pat. No. 4,550,752.

[30] Foreign Application Priority Data

| | | | |
|---|---|---|---|
| Nov. 17, 1980 | [NL] | Netherlands | 8006265 |
| Nov. 17, 1980 | [NL] | Netherlands | 8006264 |
| Dec. 31, 1980 | [NL] | Netherlands | 8007127 |
| Nov. 13, 1981 | [WO] | PCT Int'l Appl. | PCT/NL81/00026 |

[51] Int. Cl.[4] ..... D03D 47/28

[52] U.S. Cl. ..... 139/435

[58] Field of Search ..... 139/435; 226/97

[56] References Cited

U.S. PATENT DOCUMENTS

| | | | |
|---|---|---|---|
| 4,347,872 | 9/1982 | Brouwer et al. | 139/435 |
| 4,367,772 | 1/1983 | Wall | 139/435 |

FOREIGN PATENT DOCUMENTS

| | | |
|---|---|---|
| 819735 | 12/1974 | Belgium . |
| 2149343 | 4/1973 | Fed. Rep. of Germany . |
| 510765 | 9/1971 | Switzerland . |

OTHER PUBLICATIONS

Journal of Textile Machinery Society of Japan—Jul. 1961—A Study of Air-jet Looms by Uno et al., pp. 28-36.

*Primary Examiner*—Henry S. Jaudon

*Attorney, Agent, or Firm*—Burns, Doane, Swecker & Mathis

[57] ABSTRACT

This transport is effected by means of an injector, e.g. while inserting a weft thread into a weaving machine. In order to therewith keep the air consumption as low as possible the diameter of the discharge tube is made as small as possible. For nevertheless increasing the force imparted to the thread and thereby its directional stability the invention uses with an injector for subsonic inlet flow of the gas a discharge tube which widens along a very small conical angle, such that over its full length the gas obtains the speed of sound. With an injector for supersonic flow of the inlet gas this supersonic velocity is maintained along the full length of the discharge tube likewise by widening the discharge tube along a very small conical angle.

The directional stability of the thread is further increased if, by keeping constant the cross-sectional area of the discharge tube, it is flattened in the direction perpendicular to the plane of the warp threads.

2 Claims, 5 Drawing Figures

Fig. 1
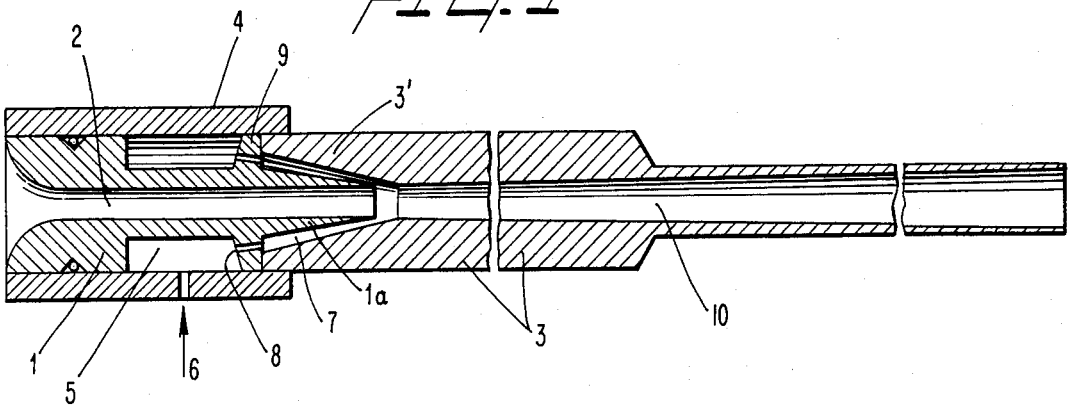
Fig. 2
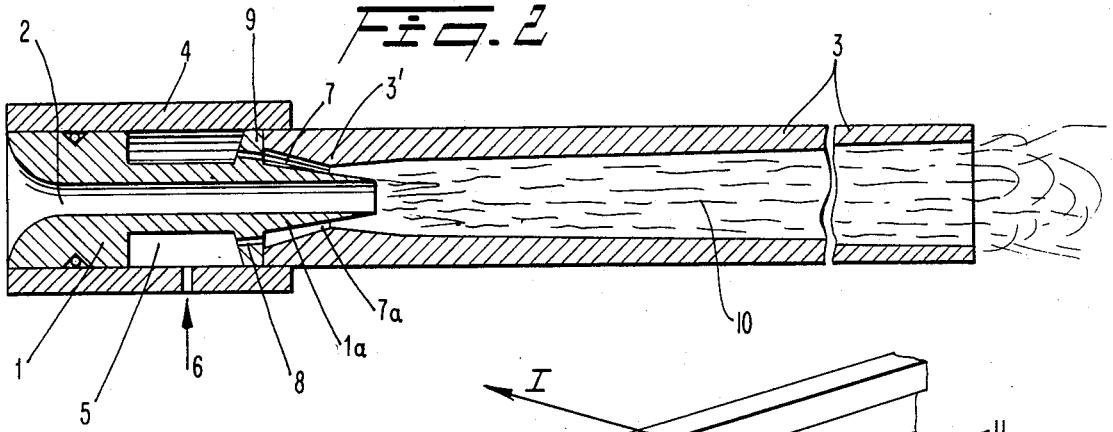
Fig. 3
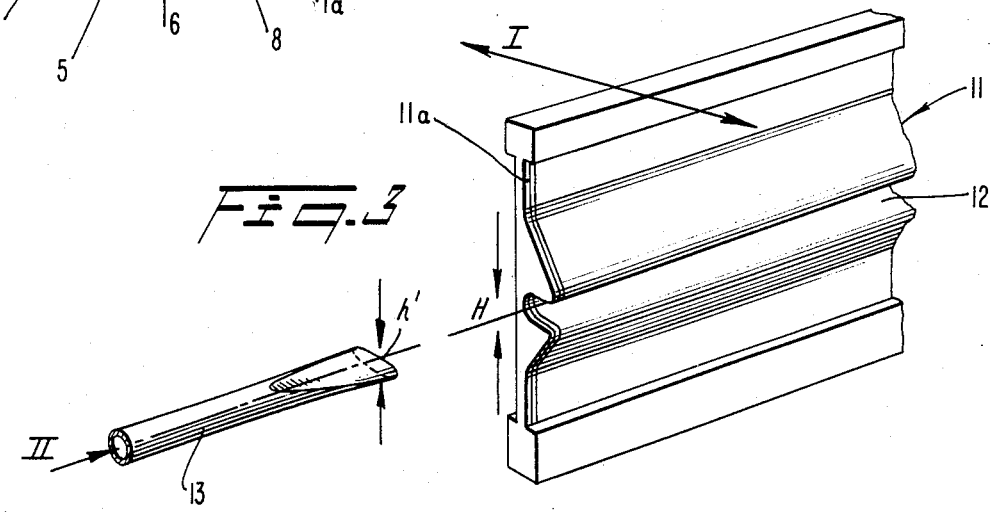
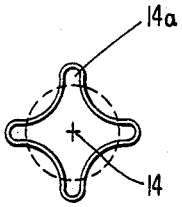
Fig. 4A
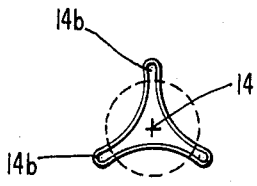
Fig. 4B

METHOD FOR CONVEYING A FLEXIBLE THREAD BY MEANS OF A PRESSURIZED GAS

This application is a continuation of application Ser. No. 394,936, filed as PCT NL81/0026, Nov. 13, 1981, published as WO82/01728, May 27, 1986, now U.S. Pat. No. 4,550,752.

The invention relates to a method for conveying a flexible thread by means of a pressurized gas, particularly for inserting a weft into the weaving shed of a weaving machine, by applying an injector of the type comprising a chamber connected to a source of the pressurized gas, a first channel extending from said chamber for a primary gas flow, a second channel merging with said first channel, in which the thread to be conveyed is supplied together with a secundary air flow, and a third channel in which both flows after they have been joined are combined into a single gas flow taking along the thread to be conveyed.

In the method as known up till this moment and which are applied in the modern pneumatic weaving machines generally injectors are used the third channel of which, also indicated by "mixing tube", has a constant cross-sectional area.

With a view to an as economic air consumption as possible and therefore a low air consumption the diameter of the mixing tube is generally minimized. A small mixing tube diameter moreover has the advantage that the path of movement followed by the conveyed thread will deviate relatively little from a predetermined average conveying path so that the injector will present a thread with large certainty within a relatively narrowly limited area at the entrance of the weaving shed of the weaving machine.

The invention aims at improving the method as performed up till now such that with a given pressure and a given air consumption the force imparted by the flowing gas to the thread to be conveyed in the conveying direction is increased and thereby the effect is improved.

According to the invention it is assumed therewith that the force F imparted by the flowing gas to the thread may be considered to be in direct proportion with (a) the length along which the thread is in contact with the flowing gas;

(b) the density of the flowing gas and (c) the square, at least an essentially higher exponent than one, of the velocity of the flowing gas.

An obvious idea would be to increase the mixing tube length. However, in a cylindrical mixing tube the velocity of the flowing gas, as seen in the direction of the axis, is not the same everywhere.

Therewith there has to be distinguished between

I. applying an injector which only permits the generation of a subsonic flow of the combined conveying gas flow and II. applying an injector which permits, dependent on the pressure used, establishing a supersonic flow of the combined conveying gas flow.

In the first case, like in the second case as long as the pressure used is too low to actually arrive at a supersonic flow, a pressure decrease will occur in the conveying direction under the influence of the friction experienced by the flowing gas from the (cylindrical) mixing tube wall which simultaneously produces a density decrease. In that with a stationary flow a like mass quantity flows through each cross-section the velocity in the cylindrical mixing tube has to be inversely proportional to the density. This implies that the velocity is maximum at the exit end of the tube.

If the feed pressure is increased the velocity initially will increase until at a predetermined value of said pressure the speed of sound is reached at the end of the mixing tube. If the feed pressure is still further increased this velocity cannot further increase but only the density will increase.

It follows from the above given consideration of the factors determining the value of the force imparted to a thread that the largest contribution to said force is given at the exit end of the mixing tube. A prolongation of the mixing tube will have increasingly less effect since the contribution is added at the side where the velocity is minimum. At the same time with an equal pressure drop less gas will be permitted to flow through the tube so that the density along the full length will be lower than may be realized with a shorter tube. Thereby a lower force contribution per unit of length will occur.

The invention now proposes to use in case of conveying a thread in a subsonic gas flow an injector in which the channel for the combined gas flow is constructed such that the ratio of the cross-section and the mass quantity flow as seen in the flow direction increases such that in each point of the flow path through the mixing tube the loss of density as a result of the friction is, at least approximately, compensated for by the larger cross-section.

This means that the velocity remains constant along the full length of the third channel (mixing tube) and that it has become possible to reach the maximum value (i.e. the speed of sound) along the full length to the thread increases correspondingly for it is that said force is proportional to the square of the velocity, which has been increased as a result of the measure according to the invention, whereas the density has only decreased linearly.

It is to be noted that the application of the inventive idea leads to mixing tube constructions in which the increase of cross-section per unit of length is relatively small. If expressed in decreased of conical angle the degree in which a tube constructed according to the invention "conically widens" will vary, dependent on the feed pressure used and on the tube length, between a fraction of one degree to maximally the order of one degree.

An injector constructed according to the invention therewith clearly differs from known injector types having conically widening mixing tubes in which an essentially larger conical angle (5° and more) of the mixing tube wall is used.

In the second case with a sufficiently high feed pressure supersonic velocities are achieved in the primary gas flow. In that case the injector used has upstream of the merging point of the first and the second channel a restriction followed by a certain increase in cross-section. Such an injector is e.g. known per se from the Dutch Pat. No. 144.672. Also with said known injector, however, a cylindrical mixing tube is used. The velocity occurring at the throat (this is the merging point of the first and the second channel) therein should be sufficiently strongly supersonic in order to achieve that the velocity after mixing with the secundary air flow sucked along with the thread is still supersonic. Thereafter the velocity will quickly decrease as a result of the friction along the cylindrical mixing tube wall. This means that the supersonic flow can be maintained in the known supersonic injector only through a very limited length whereafter the flow through a shock shifts to a subsonic flow. If the initial velocity, after the mixing range, e.g. is 1.5 times the speed of sound, this length will be maximally 10 to 15 times the mixing tube diameter and at twice the speed of sound this will be 20 to 30 times the mixing tube diameter. Realizing still higher velocities does not seem to be very realistic since the pressure of the conveying gas supply necessary therefore very quickly increases above the values of 7 to 8 bar as used at the moment.

The improvement aimed at by the invention is achieved in case of a thread conveyance in a supersonic gas flow by using an injector having a third channel constructed such that a velocity decrease which is imminent due to the friction, is compensated for, at least approximately, by a gradually increasing cross-section of said channel.

The measure according to the invention permits using an injector in which a moderate supersonic velocity (to about twice the speed of sound) may be realized which then, contrary to the known construction, may be maintained through a much larger length, particularly along the full length of the third channel. Thereby the force imparted to the thread to be conveyed, which is proportional to the square of the velocity of the conveying gas, is considerably increased.

It also applies to the second case that application of the inventive measure leads to a third channel (mixing tube) having a conical angle which not exceeds the order of one degree.

The invention likewise relates to an injector adapted to be used with the method according to the invention.

This injector is of the type comprising a chamber connected to a source of the pressurized gas, a first channel extending from said chamber for a primary gas flow, a second channel merging with said first channel, in which the thread to be conveyed is supplied together with secundary air flow, and a third channel in which both flows after they have been joined are combined into a single gas flow taking along the thread to be conveyed, and is characterized according to the invention in that the third channel has, as seen in the conveying direction, a gradually increasing cross-section, i.e. according to a conical angle between a fraction of one degree and the order of a single degree.

As is remarked above already the present case particularly deals with injectors having a mixing tube, the (average) cross-section of which is as small as possible. The air consumption then namely is minimal, while a weft thread inserted by an injector having a similar narrow mixing tube has a very good directional stability, i.e. will be presented with ample certainty within a relatively narrowly limited area at the entrance of the weaving shed.

In order to keep the inner circumferential area of the mixing tube and therewith the friction losses of the transport gas flow moving along said surface as small as possible, preferably a mixing tube having a circular cross-section will be used.

According to a further feature of the invention the circular cross-section of the third channel which gradually widens in the transport direction is deformed such at its exit end that the exit cross-section is narrowed at least in one direction, the total cross-sectional area at this point however being not essentially decreased.

By this measure the directional stability of the transported threads is increased, at least in one direction, namely in the direction in which the mixing tube section is narrowed, and is at least as great as with an injector having a comparable air consumption, the third channel of which is cylindrical.

This measure is based on the recognition that the distance whereby the weft thread may maximally deviate relative to the ideal path along the mixing tube axis, in the direction perpendicular to the plane of the warp threads (i.e. perpendicular to the reed movement) constitutes the critical point as to the directional stability of the thread.

The invention is hereunder further illustrated with reference to the drawing showing some embodiments.

FIG. 1 shows a longitudinal section through an injector according to the invention, adapted for generating a subsonic transport gas flow;

FIG. 2 is a longitudinal section through an injector according to the invention, which is suitable for generating a supersonic transport gas flow;

FIG. 3 is a perspective view of a part of a reed delimiting a transport tunnel for the weft threads, and of the end of the mixing tube of an injector according to the invention, and FIG. 4*a* and FIG. 4*b* show two modifications of the end cross-sectional shape of the mixing tube according to FIG. 3.

The injector as shown in FIG. 1 is mainly of known construction. 1 indicates an inlet piece provided with a central channel 2 for the transmission of the thread to be transported. The inlet piece 1 extends with its downstream end 1*a* into the one end of the mixing tube indicated 3. The inlet piece 1 and the mixing tube 3 are kept together and mutually centered by a housing 4 enclosing both parts. The housing 4 delimits an annular chamber 5 around the inlet piece 1 to which, at 6, the pressurized transport gas (e.g. pressurized air) may be supplied.

The mixing tube proper is constituted by that portion of the tube 3 which lies to the right of the "throat" i.e. to the right of the point where the inlet piece 1 ends, so where the secundary air flow entrained through the central channel 2 by the thread to be transported merges with the transport gas flow. The portion of the tube 3 situated to the left of said throat constitutes an adaptor 3' which together with the end 1*a* of the inlet piece delimits an annular channel 7 provided with a cross-section which decreases in the transport direction. This channel communicates with the chamber 5 through apertures 8 in a collar 9 of the inlet piece. The mixing tube proper has a mixing and transport channel 10 situated in prolongation of the central thread supply channel 2. According to the invention the cross-section of the channel 10 gradually increases in the transport direction. Thereby, with a channel having a circular cross-section, the diameter may gradually increase from a value of 3 mm to a value of 3.5 to 4 mm, with a mixing tube length within the 10 to 100 fold of the mixing tube diameter. This means a conical angle between about 0.05 and about 1 degree.

The injector according to FIG. 2 for an important part corresponds to that according to FIG. 1. Corresponding parts therefore are indicated for the sake of brevity by identical reference numbers as in FIG. 1.

Contrary to the embodiment according to FIG. 1 the annular channel 7 has in the embodiment according to FIG. 2 a restriction 7*a* spaced to the left of the "throat". This means that if a feed pressure of the transport gas is used such that at the position of this restriction 7*a* the speed of sound is reached, a further increase of said velocity may take place as a result of the expansion occurring in the channel portion to the right of the restriction 7*a*. Of course this will only occur if the quantity of secundary air which is sucked along together with the thread through the channel 2, is not too large relative to the quantity of transport gas. Starting from a predetermined quantity of transport gas thereby the cross-section of the channel 2 is bound to a maximum. The transport gas flow mixing in the first part of the mixing tube proper with the secundary air flow supplied by the channel 2 then obtains a supersonic character.

According to the invention this supersonic character may be maintained along the remainder of the mixing tube in that the mixing and transport channel 10 situated in the prolongation of the thread supply channel 2 has a gradually increasing cross-section as seen in the direction of flow. Thereby the friction losses which would lead with a cylindrical shape of the mixing tube to a quick decrease of the transport gas velocity are being compensated for by the cross-section increasing in the flow direction.

Since the force imparted to the thread to be transported is proportional to the square of the transport gas velocity this means that due to the invention, the favourable effect of the supersonic character of the transport gas flow is exploited through the full stretch of the mixing tube.

The reed 11 shown in FIG. 3 comprises in known manner contoured reed lamellae 11*a* which together delimit a conveying channel or conveying tunnel 12, open at one longitudinal side, for the weft threads to be inserted into the weaving shed of the weaving machine not further shown. During operation the reed is reciprocated in the direction of the arrow I. 13 indicates the discharge end of the mixing tube of the injector. The cross-sectional shape of the mixing tube end shown changes, as seen in the thread conveying direction II, from a circle into a more flattened shape at the discharge end of the mixing tube situated opposite to the inlet cross-section of the tunnel 12. The longitudinal axis of the discharge cross-section therewith substantially lies in the direction of movement of the reed (this is substantially parallel to the plane of the warp threads not further shown). The transition or change therewith is such that the cross-sectional area remains at least substantially constant towards the discharge end. With reference to an embodiment having a circular end cross-section the mixing tube in the embodiment according to FIG. 3 has a smaller height h' at the discharge end. It will be clear that thereby the certainty that a thread leaving the mixing tube is inserted catched within the height H of the conveying tunnel 12 is essentially increased.

FIG. 4*a* and 4*b* finally show two embodiments of a discharge cross-section for a mixing tube which is assembled from a core cross-section 4 having four protrusions 4*a* and 4*b* extending in radial direction therefrom respectively. The circumference of the undeformed portion of the mixing tube therein has been shown by broken lines.

I claim:

1. A method for conveying a flexible thread by means of a subsonic flow of pressurized gas, particularly for inserting a weft into the weaving shed of a weaving machine, provided by an injector including an inlet element wherein a first channel for a primary gas flow extends from a chamber connected to a supply of pressurized gas, a central channel conducts the thread to be conveyed together with a secondary gas flow, and a second channel merges with said first channel, further including a mixing tube abutting said inlet element and defining a third channel of circular cross-section wherein the primary and secondary gas flows are combined into a single flow transporting the thread to be conveyed, the third channel defines a restriction downstream of the merger of said first and second channels, the circular cross-section of said third channel increases, as seen in the conveying direction, by a conical angle of between a fraction of one degree and one degree, comprising the steps of:

generating the primary gas flow by connecting said inlet element to the pressurized gas supply;

conducting the secondary gas flow and the thread to be conveyed through said central channel;

combining said flows and said thread in said third channel; and compensating for a loss of density due to friction of the gas flow by the increasing cross-section of said third channel.

2. A method of conveying a flexible thread by means of a supersonic flow of pressurized gas, particularly for inserting a weft into the weaving shed of a weaving machine, provided by an injector including an inlet element wherein a first channel for a primary gas flow extends from a chamber connected to a supply of pressurized gas, a central channel conducts the thread to be conveyed together with a secondary gas flow, and a second channel merges with said first channel, further including a mixing tube abutting said inlet element and defining a third channel of circular cross-section wherein the primary and secondary gas flows are combined into a single flow transporting the thread to be conveyed, the third channel defines a restriction downstream of the merger of said first and second channels, the circular cross-section of said third channel increases, as seen in the conveying direction, by a conical angle of between a fraction of one degree and one degree, comprising the steps of:

generating the primary gas flow by connecting said inlet element to the pressurized gas supply;

conducting the secondary gas flow and the thread to be conveyed through said central channel;

combining said flows and said thread in said third channel; and compensating for a loss of velocity due to friction of the gas flow by the increasing cross-section of said third channel.

* * * * *